United States Patent [19]

LaGue et al.

[11] 3,987,838

[45] Oct. 26, 1976

[54] PARTITION SYSTEM

[75] Inventors: David H. LaGue, Shawnee Mission, Kans.; David A. Anderson, Kansas City; Stephen R. Nichols, Kansas City (North), both of Mo.

[73] Assignee: The Glen O'Brien Movable Partition Co., Inc., Kansas City, Mo.

[22] Filed: Aug. 4, 1975

[21] Appl. No.: 601,797

[52] U.S. Cl. ..... 160/351; 52/239; 160/135

[51] Int. Cl.[2] ..... A47G 5/00

[58] Field of Search ..... 160/135, 351; 52/239, 52/238, 281, 285

[56] References Cited

UNITED STATES PATENTS

| | | | |
|---|---|---|---|
| 3,359,022 | 12/1967 | Russell | 52/238 X |
| 3,559,352 | 3/1969 | Magnuson | 52/281 X |
| 3,700,385 | 10/1972 | Sherwood | 52/239 X |
| 3,762,116 | 10/1973 | Anderson et al. | 160/135 X |
| 3,766,692 | 10/1973 | Stark et al. | 160/351 X |
| 3,768,222 | 10/1973 | Birum, Jr. | 160/135 X |

*Primary Examiner*—Philip C. Kannan
*Attorney, Agent, or Firm*—Fishburn, Gold & Litman

[57] ABSTRACT

A partition system for use in defining selected areas within a larger space includes a plurality of upstanding support posts arranged in spaced relation and each having mounting structure thereon adapted to receive and retain thereon spaced locking portions of respective end edge members mounted on respective wall panels. The mounting structure has a plurality of longitudinally extending and circumferentially spaced ribs each adapted for cooperative locking engagement with a respective one of the locking portions of a respective one of the end edge members.

11 Claims, 10 Drawing Figures

PARTITION SYSTEM

The present invention relates to partition systems and more particularly to a partition system which includes upstanding support posts each having mounting structure thereon adapted to receive and retain thereon spaced locking portions of respective end edge members mounted on respective wall panels.

Principal objects of the present invention are: to provide a partition system for use in defining selected areas within a larger space and which is versatile in arrangement; to provide such a partition system including mounting structure having circumferentially spaced ribs adapted to be in cooperative locking engagement with respective locking portions of respective end edge members mounted on wall panels; to provide such a partition system wherein the members of the mounting structure have an outwardly extending flange for supporting thereon one end portion of a bottom edge member mounted on the wall panels; to provide such a partition system in which the posts and mounting structure permits arrangement of multiple panels extending from a post at selected angular relation; to provide such a partition system wherein the locking portions and the ribs of the mounting members are substantially rigid members whereby locking engagement is accomplished by effecting relative longitudinal movement between the mounting members and the end edge members; to provide such a partition system wherein the locking portions of top and bottom edge members on the wall panels have a closure member in locking engagement therewith; to provide such a partition system wherein the edge members on wall panels have outwardly open recesses on opposite exterior surfaces and receive respective elongated trim members therein; to provide such a partition system including upright trim members having vertically spaced slots therein adapted to receive shelf brackets for supporting shelves thereon; and to provide such a partition system including free standing, portable, and movable dividers and which is attractive in appearance, durable in construction, and particularly well adapted for the proposed use.

Other objects and advantages of this invention will become apparent from the following description taken in connection with the accompanying drawings wherein are set forth, by way of illustration and example, certain embodiments of this invention.

The drawings constitute a part of the specification and include an exemplary embodiment of the present invention and illustrate various objects and features of the partition system.

Figure 1:
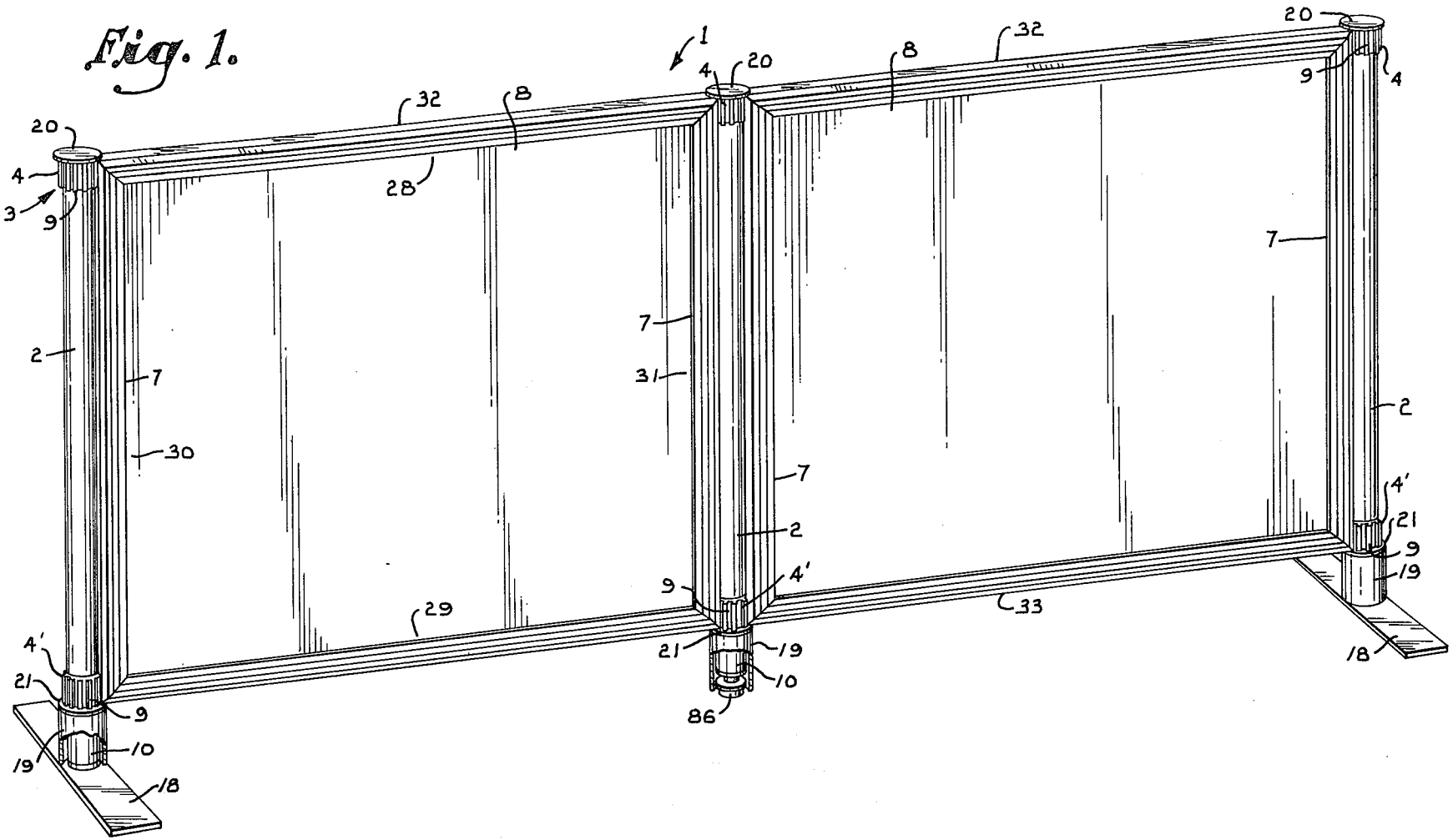
FIG. 1 is a perspective view showing components of a partition system embodying features of the present invention and with portions broken away to better illustrate construction thereof.
Figure 2:
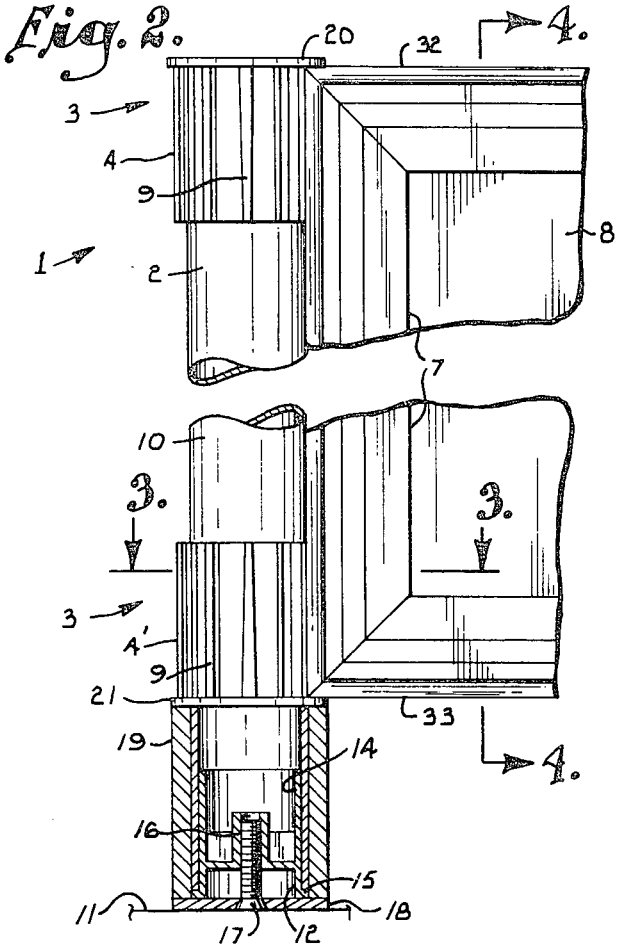
FIG. 2 is an enlarged fragmentary elevational view of a partition showing one support post and mounting members thereon with portions broken away to better illustrate construction thereof.
Figure 3:
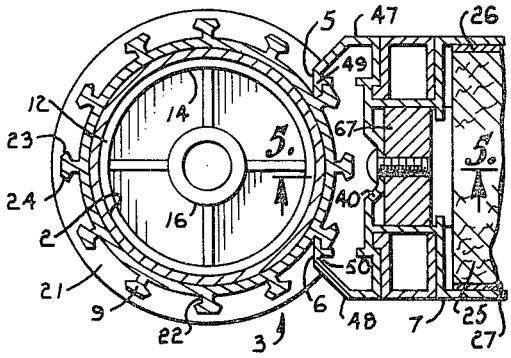
FIG. 3 is an enlarged fragmentary transverse sectional view taken on line 3—3 of FIG. 2 and showing cooperative locking engagement between mounting members and locking portions of edge members on a wall panel.
Figure 4:
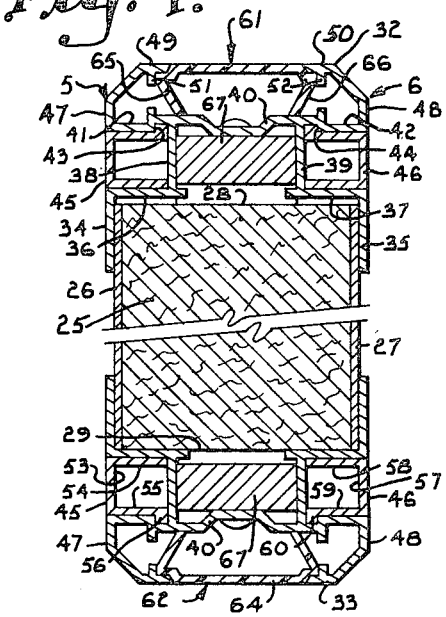
FIG. 4 is an enlarged fragmentary transverse sectional view taken on line 4—4 of FIG. 2 and showing a closure member in top and bottom edge members on the wall panel.
Figure 6:
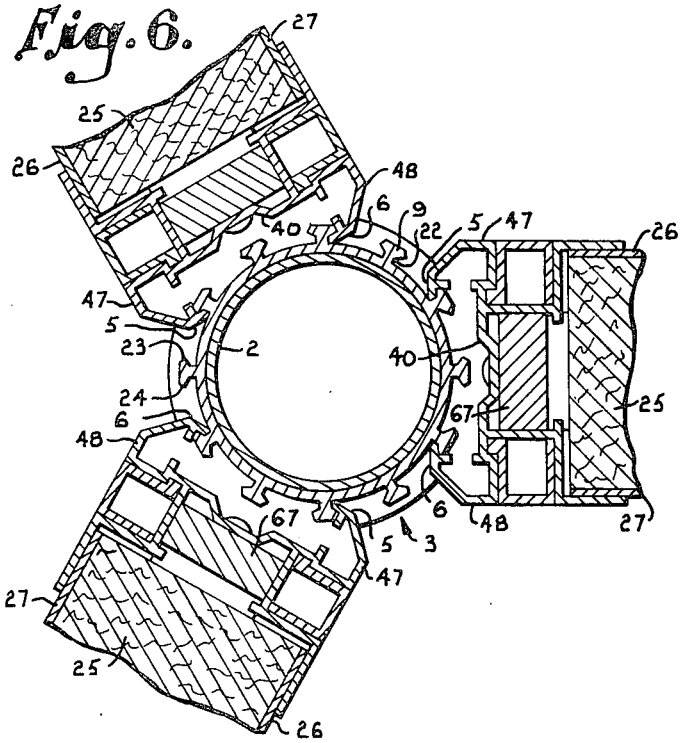
FIG. 6 is an enlarged fragmentary transverse sectional view similar to FIG. 3 except showing wall panels circumferentially spaced on 120° centers.

As required, detailed embodiments of the present invention are disclosed herein. However, it is to be understood that the disclosed embodiments are merely exemplary of the invention which may be embodied in various forms. Therefore, specific functional and structural details disclosed herein are not to be interpreted as limiting but merely as a basis for the claims and as a representative basis for teaching one skilled in the art to variously employ the present invention in virtually any appropriately detailed structure.

Referring more in detail to the drawings:

In the disclosed embodiment of the present invention, the reference numeral 1 designates generally a partition system for use in defining selected areas within a larger space. The partition system 1 includes a plurality of upstanding support posts 2 arranged in spaced relation and each having mounting structure 3 adapted to receive and retain thereon spaced locking portions 5 and 6 of respective end edge members 7 mounted on respective wall panels 8. The mounting structure 3 has a plurality of longitudinally extending and circumferentially spaced ribs 9 each adapted for cooperative locking engagement with a respective one of the locking portions 5 and 6 of a respective one of the end edge members 7.

The posts 2 may be any desired shape and are illustrated as tubular members of circular cross section. A lower end portion 10 of the support posts 2 may be supported in any desired manner on a floor or other support surface 11.

In the illustrated structure, a connector or plug 12 is received in the lower end portion 10 of the post 2. The plug 12 has a wall portion 14 having an exterior surface thereof in sliding engagement with an interior surface of the lower end portion 10 of the post 2. The plug 12 has an end flange 15 extending outwardly from the wall portion 14 thereof for supporting the lower end portion 10 of the respective post 2 thereon. The plug 12 has an internally threaded core 16 adapted to receive a suitable fastener, such as a screw, bolt 17, or a threaded shaft of a leveler glide. An elongated foot 18 may also be secured to the plug 12 by a fastener 17.

When a lower edge of a wall panel 8 is to be spaced above the support surface 11, a decorative sleeve 19 may be mounted on the lower end portion 10 of the support post 2 and positioned below the mounting structure 3 to hide or conceal the end flange 15 of the plug 12. When the lower edge of the wall panel 8 is to be adjacent the support surface 11, the sleeve 19 may be omitted and the lower mounting member 4' positioned at or adjacent the bottom of the support post 2.

The illustrated mounting structure 3 includes upper and lower mounting members 4 and 4′ which are each tubular members having a cross sectional shape similar to the shape of the respective post and adapted for longitudinal movement along the support post 2. The mounting members 4 and 4′ have end flanges 20 and 21 respectively extending outwardly from one end thereof. The end flange 20 of the upper mounting member 4 is in engagement with an upper end of the support post 2. The end flange 21 of the lower mounting member 4′ provides support for one end portion of the wall panels 8 supported on the post 2.

The ribs 9 of the upper and lower mounting members 4 and 4′ are generally T-shaped and extend between opposite ends of the respective mounting members to thereby define substantially rigid members. The exterior or outwardly facing surface of the ribs 9 is generally parallel with the exterior or outwardly facing surface of the respective mounting member. Each rib 9 includes a stem portion 22 extending perpendicular to or radially outwardly from the respective mounting members 4 and 4′. Each rib 9 includes a pair of lugs 23 and 24. In the illustrated embodiment, inwardly facing surfaces of the lugs 23 and 24 are sloped outwardly from the stem portion 22. An exterior or outwardly facing surface of the ribs 9 and lugs 23 and 24 are coplanar and taper from adjacent the end flanges 20 and 21 toward the other end of the mounting members 4 and 4′ respectively.

The wall panels 8 may be of any desired construction and preferably each have a core portion 25 and facia members 26 and 27 of any suitable material, such as decorative hood material, fabric, carpet, or the like, mounted thereon and having outwardly facing surfaces respectively. Each wall panel 8 has top and bottom edge portions 28 and 29 respectively and opposite end portions 30 and 31. The end portions 30 and 31 each have an end edge member 7 mounted thereon and the top and bottom edge portions 28 and 29 have top and bottom edge members 32 and 33 respectively mounted thereon.

The end edge member 7 and the top and bottom edge members 32 and 33 each have opposed flange portions 34 and 35 with inwardly facing surfaces thereof in engagement with an exterior surface of the facia members 26 and 27 respectively. Wall portions 36 and 37 are coplanar one with the other and extend inwardly from the opposed flange portions 34 and 35 respectively. The wall portions 36 and 37 are substantially perpendicular to the flange portions 34 and 35 respectively and have end edges thereof in facing relation. The wall portions 36 and 37 are adapted to be in engagement with or in facing relation with a respective adjacent edge of the wall panel 8. Connection members 38 and 39 extend between the wall portions 36 and 37 and the locking portions 5 and 6 respectively. The connection members 38 and 39 are substantially perpendicular to the wall portions 36 and 37.

The locking portions 5 and 6 include a web member 40 positioned substantially parallel with the wall portions 36 and 37 and generally perpendicular or normal to the connection members 38 and 39. The web member 40 has end portions 41 and 42 extending outwardly of the connecting members 38 and 39. The end portions 41 and 42 of the web member 40 have offsets therein defining inwardly facing shoulders 43 and 44 respectively, for a purpose later described.

The wall portion 36, connecting member 38, and end portion 41 are arranged to define one or a first outwardly open recess in each of the end member 7 and in the top and bottom edge members 32 and 33 adapted to receive therein a respective first trim member 45, as later described. The wall portion 37, connecting member 39, and end portion 42 are arranged to define a second outwardly open recess in each of the end edge members 7 and in the top and bottom edge members 32 and 33 respectively to receive therein a respective second trim member 46, as later described.

The locking portions 5 and 6 have flange portions 47 and 48 extending from and substantially perpendicular to the end portions 41 and 42 respectively of the web member 40. The flange portions 47 and 48 of the locking portions 5 and 6 are substantially coplanar with the flange portions 34 and 35 of the respective edge member. End walls 49 and 50 extend from the flange portions 47 and 48 respectively and are substantially parallel with the web member 40. The end walls 49 and 50 terminate at edges in facing relation. The end walls 49 and 50 have abutment members or ribs extending from an interior face thereof to define inwardly facing shoulders 51 and 52 respectively each engageable with a respective one of the lugs 23 and 24 of the ribs 9 of the mounting members 3 and 4.

The locking portions 5 and 6 of each of the edge members is a substantially rigid member whereby the cooperative locking engagement between the locking portions 5 and 6 and the ribs 9 is accomplished by effecting relative longitudinal movement between the respective mounting members and the opposite end portions of the end edge members 7.

The first and second trim members 45 and 46 are each generally U-shaped members mounted in respective outwardly open recesses of the edge members. The first trim member 45 has a web portion 53 with an exterior surface thereof substantially coplanar with the exterior surface of the flange portions 34 and 47 of the respective edge member. The first trim member 45 includes flanges 54 and 55 positioned in engagement with the wall portion 36 and the end portion 41 respectively. The flange 55 in engagement with the end portion 41 has a rib 56 thereon with an outwardly facing surface thereof in engagement with the inwardly facing shoulder 43 of the end portion 41.

The second trim member 46 has a web portion 57 with an exterior surface thereof substantially coplanar with the exterior surface of the flange portions 35 and 48 of the respective edge members. The second trim member 46 includes flanges 58 and 59 positioned in engagement with the wall portion 37 and the end portion 42. The flange 59 in engagement with the end portion 42 has a rib 60 thereon with an outwardly facing surface thereof in engagement with the inwardly facing shoulder 44 of the end portion 42.

The mounting of the trim members 45 and 46 in the respective outwardly open recess in an edge member is accomplished by effecting relative longitudinal movement therebetween. Engagement of the ribs 56 and 60 with the inwardly facing shoulders 43 and 44 is effective to retain the trim members in the respective outwardly open recesses.

It is desirable to provide a finished appearance for the partition system, therefore, top and bottom closure members 61 and 62 are mounted on the top and bottom edge members 32 and 33 respectively. An end closure member 63 may be mounted in an edge member 7 when not mounted on the support post 2 and the mounting members 4 and 4′ thereon.

In the illustrated embodiment, each of the closure members 61, 62, and 63 have a wall member 64 having an exterior surface thereof substantially coplanar with an exterior surface of the end walls 49 and 50 defining the locking portions 5 and 6 of the respective edge member. The closure members each have means on opposite side portions thereof defining outwardly facing shoulders each adapted for cooperative locking engagement with a respective one of the locking portions 5 and 6 of the respective edge members. In the illustrated embodiment, opposite side edge portions of the wall members 64 are offset to define outwardly facing shoulders engageable with the inwardly facing ends of the end walls 49 and 50. Opposite side edges of the wall member 64 are in engagement with the inwardly facing shoulders 51 and 52 on the end walls 49 and 50 respectively. The closure members 61, 62, and 63 each have flanges 65 and 66 extending from opposite side edge portions of the wall member 64 thereof and the flanges 65 and 66 are in engagement with the web member 40 of the respective edge member.

Figure 5:
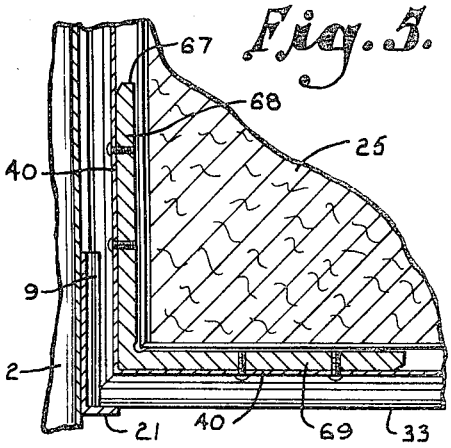
FIG. 5 is an enlarged fragmentary longitudinal sectional view taken on line 5—5 of FIG. 3 and showing corner construction of the edge members.

The end edge members 7 are connected to the top and bottom edge members 32 and 33 at respective corners of the wall panels. The corners defined by abutting ends of the edge members and trim members are preferably mitered for appearance. Connectors 67 in the form of angles are positioned at the corners of the edge members and have first and second legs 68 and 69 thereof mounted on the web member 40 of adjacent edge members, as best seen in FIG. 5.

Figure 7:
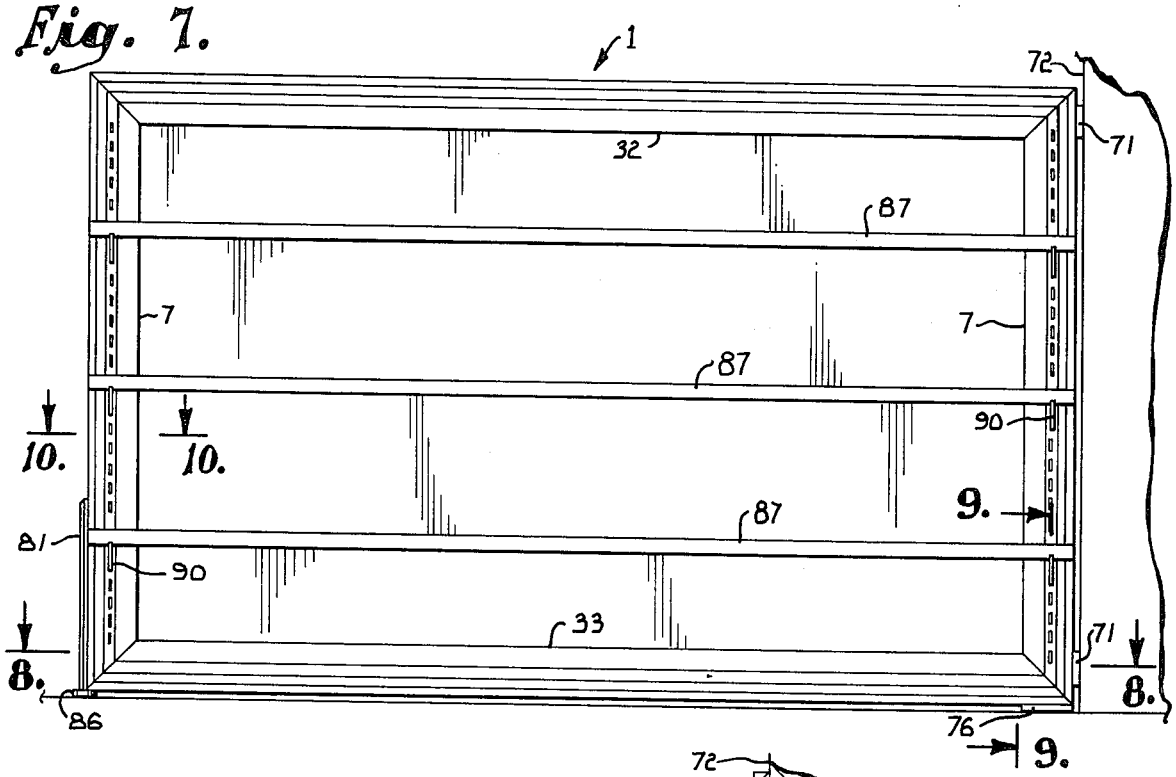
FIG. 7 is an elevational view of a partition with shelves mounted thereon and having one end supported on a wall and the other end supported on an individual panel support or leg support member.
Figure 8:
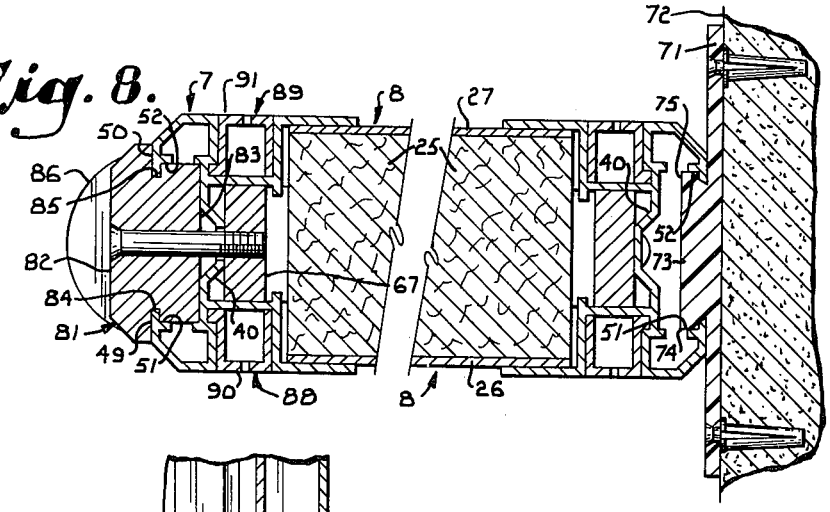
FIG. 8 is an enlarged fragmentary transverse sectional view taken on line 8—8 of FIG. 7 and showing a wall anchor and a leg support member at opposite ends of a wall panel.
Figure 9:
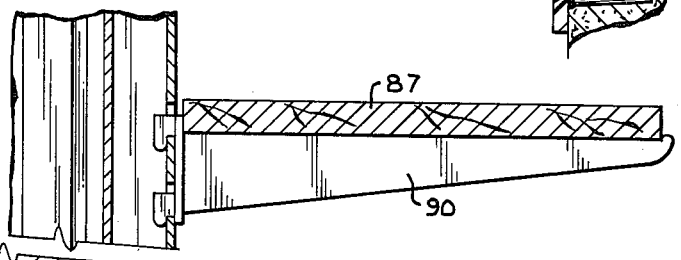
FIG. 9 is an enlarged fragmentary transverse sectional view taken on line 9—9 of FIG. 7 and showing mounting means for shelves.
Figure 9:
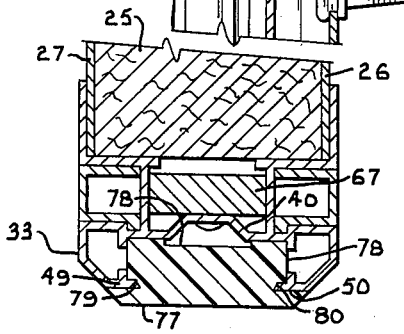
Figure 10:
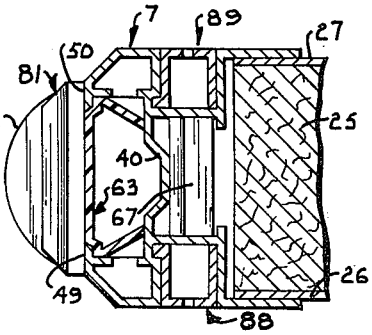

FIGS. 7 to 9 inclusive illustrate additional components and features of the partition system 1. An end edge member 7 on one end of the wall panel 8 is mounted on a wall and in the illustrated structure, wall anchors 71 are suitably secured to a wall surface 72, as by expansion bolts, screws, or the like. Each wall anchor 71 is a generally planar member having fastening portions extending therefrom and adapted for cooperative engagement with the locking portions 5 and 6 of respective end edge members 7. The illustrated fastening portions include a projection 73 extending outwardly therefrom and having ears 74 and 75 extending laterally from opposite side edges thereof. The ears 74 and 75 have end edges thereof in engagement with the inwardly facing shoulders 51 and 52 respectively. The wall anchors 71 are illustrated as relatively narrow members and any number may be mounted on the respective end edge member 7 and secured to the wall surface 72.

A shim member 76 is mounted in an end portion of the bottom edge member 33 and positioned adjacent the wall surface 72 thereby pivoting support for the end portion of the wall panel 8. The shim member 76 is illustrated as a generally rectangular member and includes a face portion 77 and a mounting portion 78. The face portion 77 has inwardly facing surfaces in engagement with the exterior surface of the end walls 49 and 50 of the bottom edge member 33. The shim member 76 has outwardly open recesses 79 and 80 adapted to receive therein the end wall 49 and 50 respectively. Opposite faces of the mounting portion 79 are adapted to be in engagement with the inwardly facing shoulders 51 and 52 respectively. The shim member 76 preferably has one surface of the mounting portion 78 thereof in engagement with the adjacent surface of the web member 40 of the respective bottom edge 33.

In the partition illustrated in FIGS. 7 to 9 inclusive, an individual panel support or leg support member 81 is mounted on the end edge member 7 at the other end of the wall panel 8. The leg support member 81 includes a face portion 82 and a mounting portion 83. The face portion 82 has an inwardly facing surface in engagement with an exterior surface of the end walls 49 and 50 of the end edge member 7 at the other end of the wall panel 8.

The leg support member 81 has outwardly open recesses 84 and 85 adapted to receive therein the end walls 49 and 50 respectively of the end edge member 7. Opposite faces of the mounting portion 83 are adapted to be in engagement with the inwardly facing shoulders 51 and 52 respectively. The leg support member 81 preferably has one surface of the mounting portion 83 thereof in engagement with the adjacent surface of the web member 40 of the respective end edge member 7.

The leg support member 81 is suitably mounted on the end edge member 7, as by a plurality of screws extending through the leg support member 81 and the web member 40 of the end edge member 7. A lower end portion of the leg support member 81 has an internally threaded bore adapted to receive therein an externally threaded shank or pin of a leveler glide 86.

The partition illustrated in FIG. 7 has a plurality of shelves 87 mounted thereon. Modified trim members 88 and 89 are mounted in the outwardly open recesses in the end edge members 7 positioned at opposite ends of the wall panel 8. The modified trim members 88 and 89 are similar in construction to the first and second trim members 45 and 46 except that web portions 90 and 91 of the modified trim members 88 and 89 respectively each have a plurality of vertically extending slots therein adapted to receive hook portions of shelf brackets 90 therein for supporting the shelves 87 thereon.

Assembly of the components of the partition system 1 includes mounting of the end edge members 7 and the top and bottom edge members 32 and 33 on the wall portion 8 and securing same in position by the connectors 67. The trim members 45 and 46 are mounted in respective outwardly open recesses in the respective edge members by sliding same thereinto from one end of the respective edge member prior to connection with other edge members to be mounted on the wall panel 8. When the wall panel 8 is to be mounted on a support post 2, the lower mounting member 4′ is positioned on the post 2 at a desired spacing above the support surface 11 and secured thereon, as by a rivet or screw. The foot 18 or a suitable glide is connected to the plug 12 with or without the decorative sleeve 19 being mounted on the lower end portion 10 of the post 2. The closure members 61, 62, and 63 are mounted on the respective edge members, as by being moved longitudinally thereof preferably prior to mounting of the connector 67 at the corners of the wall panel 8. One end portion of the bottom edge member 33 and the locking portions 5 and 6 of an adjacent end edge member 7 are positioned above the lower mounting member 4′ on the support post 2 and in engagement with respective ribs 9 thereon. The end portion of the bottom edge member 33 is lowered until moved into supported engagement with the end flange 21 of the lower mounting member 4. The process of lowering the end portion of the bottom edge member 33 is repeated for the desired number of wall panels 8 to be supported on the support post 2. The upper mounting member 4 is positioned with the lugs 23 and 24 of the ribs 9 thereof in engagement with the locking portions 5 and 6 of the upper end portion of each of the end edge members 7 mounted on the post 2 and then moved downwardly until the end flange 20 thereof is in engagement with the top edge member 32 mounted on all of the panels 8 to be supported on the post 2. The components illustrated in FIGS. 7 to 9 inclusive are assembled in substantially similar manner.

It is to be understood that while we have illustrated and described one form of our invention, it is not to be limited to the specific form or arrangement of parts herein described and shown.

What we claim and desire to secure by Letters Patent is:

1. A partition system comprising:

a. at least two upstanding support structures with at least one having a support means on a lower end thereof for engagement with a support surface;

b. a mounting structure mounted on said one of said support structures, said mounting structure including 1. an upper tubular mounting member mounted on an upper end portion of said one of said support structures and adapted for longitudinal movement thereon;
2. a lower tubular mounting member mounted on the lower end portion of said one of said support structures and adapted for longitudinal movement thereon;
3. means retaining said upper and lower tubular mounting member in selected positions on said one support structure; and
4. and end flange extending outwardly from said lower mounting member and having one end portion of said edge member on the bottom edge portion of said panel in supported engagement thereon;

c. a plurality of longitudinally extending and circumferentially spaced ribs on said tubular mounting members, said ribs each having a pair of lugs extending laterally therefrom;

d. at least one panel having peripheral edge portions including opposite end edge portions and a top edge portion and a bottom edge portion, said panel having facia members each having an outwardly facing surface;

e. a plurality of elongated edge members each mounted on a respective one of said peripheral edge portions of said panel and each having flange portions thereof in engagement with the outwardly facing surface of a respective one of said facia members, said edge members each having opposite end portions; and f. a pair of locking portions extending from one of said edge members and adapted for cooperative locking engagement with lugs of respective ribs of said mounting structure to thereby retain said panel on said one support structure.

2. A partition system as set forth in claim 1 wherein:

a. said upper tubular mounting member has an outwardly extending end flange on one end thereof; and b. said end flange on the upper tubular mounting member is in engagement with one end portion of said edge member on the top edge portion of said panel.

3. A partition system as set forth in claim 1 wherein:

a. said ribs of said mounting structure are each substantially rigid members; and b. each locking portion of each pair of locking portions is a substantially rigid member whereby the cooperative locking engagement between said locking portions and said ribs is effected by relative longitudinal movement between the respective mounting members and opposite end portions of said edge members.

4. A partition system as set forth in claim 2 including:

a. a pair of locking portions extending from the other of said edge members;

b. a plurality of elongated closure members each mounted on a respective one of said edge members, said closure members each having opposite side edge portions; and c. means on each of said opposite side edge portions of each of said closure members defining outwardly facing shoulders each adapted for cooperative locking engagement with a respective one of said locking portions of said respective edge members.

5. A partition system comprising:

a. at least two upstanding support structures with at least one having a support means on a lower end thereof for engagement with a support surface;

b. a mounting structure mounted on said one of said support structures;

c. a plurality of longitudinally extending and circumferentially spaced ribs on said mounting structure, said ribs each having a pair of lugs extending laterally therefrom;

d. at least one panel having perpendicular edge portions including opposite end edge portions and a top edge portion aand a bottom edge portion, said panel having facia members each having an outwardly facing surface;

e. a plurality of elongated edge members each mounted on a respective one of said peripheral edge portions of said panel and each having flange portions thereof in engagement with the outwardly facing surface of a respective one of said facia members, said edge members each having opposite end portions;

f. a pair of locking portions extending from one of said edge members and adapted for cooperative locking engagement with lugs of respective ribs of said mounting structure to thereby retain said panel on said one support structure;

g. said mounting structure includes an upper and a lower mounting member mounted on said one of said support structures;

h. said mounting members are each tubular members adapted for longitudinal movement along said one of said support structures;

i. said mounting members each have an outwardly extending end flange on one end thereof;

j. said end flange of the lower mounting member has one end portion of said edge member on the bottom edge portion of said panel in supported engagement thereon; and k. said end flange of the upper mounting member is in engagement with one end portion of said edge member on the top edge portion of said panel.

6. A partition system comprising:

a. at least two upstanding support structures with at least one having a support means on a lower end thereof for engagement with a support surface;
b. a mounting structure mounted on said one of said support structures;
c. a plurality of longitudinally extending and circumferentially spaced ribs on said mounting structure, said ribs each having a pair of lugs extending laterally therefrom;
d. at least one panel having peripheral edge portions including opposite end edge portions and a top edge portion and a bottom edge portion, said panel having facia members each having an outwardly facing surface;
e. a plurality of elongated edge members each mounted on a respective one of said peripheral edge portions of said panel and each having flange portions thereof in engagement with the outwardly facing surface of a respective one of said facia members, said edge members each having opposite end portions;
f. a pair of locking portions extending from one of said edge members and adapted for cooperative locking engagement with lugs of respective ribs of said mounting structure to thereby retain said panel on said one support structure;
g. said mounting structure includes an upper and a lower mounting member mounted on said one of said support structures;
h. said mounting members are each tubular members adapted for longitudinal movement along said respective support posts;
i. said mounting members each have an outwardly extending end flange on one end thereof;
j. said end flange on each of the lower mounting members has one end portion of said edge member on the bottom edge portion of said panel in supported engagement thereon;
k. said end flange of each of the upper mounting members is in engagement with one end portion of said edge member on the top edge portion of said panel;
l. said ribs of said mounting members are each substantially rigid members; and
m. each locking portion of each pair of locking portions is a substantially rigid member whereby the cooperative locking engagement between said locking portions and said ribs is effected by relative longitudinal movement between the respective mounting members and opposite end portions of said edge members.

7. A partition system as set forth in claim 6 including:
a. wall members on each of said edge members defining a pair of outwardly open recesses each adjacent a respective one of said flange portions thereof;
b. an inwardly facing shoulder on at least one of said wall members defining each of said recesses;
c. a pair of trim members for each of said edge members and each positioned in a respective one of said outwardly open recesses therein;
d. a rib on each of said trim members and having an outwardly facing surface thereof in engagement with said respective inwardly facing shoulder of said one recess defining wall member;
e. a pair of locking portions extending from the other of said edge members;
f. a plurality of elongated closure members each mounted on a respective one of said edge members, said closure members each having opposite side edge portions; and
g. means on each of said opposite members defining outwardly facing shoulders each adapted for cooperative locking engagement with a respective one of said locking portions of said respective edge members.

8. A partition system as set forth in claim 6 including:
a. wall members on each of said edge members defining a pair of outwardly open recesses each adjacent a respective one of said flange portions thereof;
b. an inwardly facing shoulder on at least one of said wall members defining each of said recesses;
c. a pair of trim members for each of said edge members and each positioned in a respective one of said outwardly open recesses therein; and
d. a rib on each of said trim members and having an outwardly facing surface thereof in engagement with said respective inwardly facing shoulder of said one recess defining wall member.

9. A partition system comprising:
a. a plurality of upstanding support posts each having support means on a lower end thereof for engagement with a support surface;
b. a pair of tubular mounting members for and mounted on each of said support posts and arranged as upper and lower mounting members for and mounted on each of said support posts, said mounting members each having an outwardly extending end flange on one end thereof;
c. a plurality of longitudinally extending and circumferentially spaced ribs on each of said mounting members, said ribs each having a pair of lugs extending laterally therefrom;
d. a plurality of panels each positioned between a respective pair of said support posts and having peripheral edge portions including opposite side edge portions and a top edge portion and a bottom edge portion, said panels each having an pair of facia members each having an outwardly facing surface;
e. a plurality of elongated edge members each mounted on a respective one of said peripheral edge portions of a respective one of said panels and each having a pair of flange portions thereof each in engagement with the outwardly facing surface of a respective one of said facia members, said edge members each having opposite end portions, each of the opposite end portions of said edge members mounted on the bottom edge portion of said panels being in supported engagement with said end flange of said respective lower mounting member;
f. a pair of locking portions extending from each of said edge members and each adapted for cooperative locking engagement with one of said lugs of a respective one of said ribs of said mounting members to thereby retain said panel on said support posts, said pair of locking portions of each of said edge members having inwardly facing and opposed abutment members each adapted to be in engagement with a respective one of said lugs;
g. wall members on each of said edge members defining a pair of outwardly open recesses each positioned between a respective one of said flange portions and a respective one of said locking portions thereof;
h. an inwardly facing shoulder on at least one of said wall members defining each of said recesses;

i. a pair of trim members for each of said edge members and each positioned in a respective one of said outwardly open recesses therein; and j. a rib on each of said trim members and having an outwardly facing surface thereof in engagement with said respective inwardly facing shoulder of said one recess defining wall member.

10. A partition system as set forth in claim 9 including:

a. a plurality of elongated closure members each mounted on a respective one of said edge members, said closure members each having opposite side edge portions; and b. means on each of said opposite side edge portions of each of said closure members defining outwardly facing shoulders each adapted for cooperative locking engagement with said inwardly facing abutment member of a respective one of said locking portions of said respective edge members.

11. A partition system comprising:

a. a plurality of upstanding support posts each having support means on a lower end thereof for engagement with a support surface;

b. a pair of tubular mounting members mounted on each of said support posts and movable longitudinally thereof and arranged as upper and lower mounting members, said mounting members each having an outwardly extending end flange on one end thereof;

c. means retaining said upper and lower mounting members in selected positions on said support posts;

d. a plurality of longitudinally extending and circumferentially spaced ribs on each of said mounting members, said ribs each having a pair of lugs extending laterally therefrom;

e. a plurality of panels each positioned between a respective pair of said support posts and having peripheral edge portions including opposite side edge portions and a top edge portion and a bottom edge portion, said panels each having a pair of facia members each having an outwardly facing surface;

f. a plurality of elongated edge members each mounted on a respective one of said peripheral edge poertions of a respective one of said panels and each having a pair of flange portions thereof each in engagement with the outwardly facing surface of a respective one of said facia members, said edge members each having opposite end portions, each of the opposite end portions of said edge members mounted on the bottom edge portion of said panels being in supported engagement with said end flange of said respective lower mounting member; and g. a pair of locking portions extending from each of said edge members and each adapted for cooperative locking engagement with one of said lugs of a respective one of said ribs of said mounting members to thereby retain said panel on said support posts, said pair of locking portions of each of said edge members having inwardly facing and opposed abutment members each adapted to be in engagement with a respective one of said lugs.

* * * * *